US007417655B2

(12) United States Patent
Tsubota

(10) Patent No.: US 7,417,655 B2
(45) Date of Patent: Aug. 26, 2008

(54) PRINTER AND PRINTING METHOD FOR RECORDING IMAGE DURING MOVEMENT OF RECORDING PAPER

(75) Inventor: Keiji Tsubota, Saitama (JP)

(73) Assignee: FUJIFILM Corporation, Tokyo (JP)

( * ) Notice: Subject to any disclaimer, the term of this patent is extended or adjusted under 35 U.S.C. 154(b) by 249 days.

(21) Appl. No.: 11/455,763

(22) Filed: Jun. 20, 2006

(65) Prior Publication Data

US 2006/0284965 A1 Dec. 21, 2006

(30) Foreign Application Priority Data

Jun. 21, 2005 (JP) ..... 2005-180946

(51) Int. Cl.
*B41J 2/32* (2006.01)

(52) U.S. Cl. ..... 347/171; 347/172; 347/175; 347/176; 347/174

(58) Field of Classification Search ..... 347/171, 347/172, 174, 175, 176
See application file for complete search history.

(56) References Cited

U.S. PATENT DOCUMENTS 6,769,759 B2 * 8/2004 Yamasaki et al. ..... 347/41

FOREIGN PATENT DOCUMENTS

JP 11-146676 A 5/1999

OTHER PUBLICATIONS

Computer-generated translation of JP 11-146676 cited in the IDS filed on Jun. 20, 2006.*

* cited by examiner

*Primary Examiner*—Huan H Tran
(74) *Attorney, Agent, or Firm*—Sughrue Mion, PLLC

(57) ABSTRACT

A printer comprises a feed roller to which driving force is transmitted from a motor via a reducer. While the feed roller moves a recording paper, an image is recorded by a line print head one line by one line. The feed roller is provided with a rotary encoder. A controller counts encoder pulses (measured EP) of the rotary encoder to measure an actual feed amount of the recording paper. Whenever five lines are recorded, the measured EP is compared with predetermined reference encoder pulses to detect a feed error of the recording paper. In case that slipping or the like occurs on the reducer, delay in feeding the recording paper is caused. A printing cycle of the next five lines is adjusted so as to eliminate the feed error. In this way, a printing length of one frame is adjusted to a target printing length.

16 Claims, 5 Drawing Sheets

PRINTER AND PRINTING METHOD FOR RECORDING IMAGE DURING MOVEMENT OF RECORDING PAPER

FIELD OF THE INVENTION

The present invention relates to a printer and a printing method for recording an image by a print head during movement of a recording paper.

BACKGROUND OF THE INVENTION

A color thermal printer using a color thermosensitive recording paper is known. The color thermosensitive recording paper comprises three thermosensitive coloring layers which are formed on a support to color in yellow, magenta and cyan respectively. The color thermal printer colors the color thermosensitive recording paper by heating it with a thermal head. The color thermal printer records images of the respective colors in a frame sequential manner so that a full-color image of one frame is obtained. In the thermal head, for example, a plurality of heating elements corresponding to pixels are aligned in a scanning direction. Thermal recoding is performed while the color thermosensitive recording paper is moved in a feeding direction in a condition that the thermal head is pressed against the color thermosensitive recording paper.

The color thermosensitive recording paper is moved by a feed roller. For example, the feed roller is driven by a stepping motor, rotation of which is transmitted to the feed roller via a reducer. As to this reducer, a traction-driven type (see Japanese Patent Laid-Open Publication No. 11-146676) is used for instance. As is well known, the reducer of the traction-driven type comprises a sun roller to which the rotation of the motor is inputted, and planetary rollers disposed around the sun roller. The planetary rollers slide on and revolve about the sun roller. The reducer of the traction-driven type further comprises an output shaft driven by the revolution of the planetary rollers.

The reducer of the traction-driven type has lesser backlash in comparison with a reducer of a gear type. In addition, speed fluctuation is also lesser. Consequently, when the reducer of the traction-driven type is employed in a system for driving the feed roller of the printer, speed fluctuation of the recording paper is restrained. Thus, there is an advantage that color unevenness is restrained. Meanwhile, in the above-mentioned Publication No. 11-146676, a roller to which the motor transmits the rotational force via the reducer is provided with a rotary encoder. Encoder pulses generated by the rotary encoder are detected to perform feedback control for a rotating speed of the motor so that rotational unevenness of the roller is restrained.

As for the reducer of the traction-driven type, although the rotational unevenness is restrained, there is a problem in that reduction ratios of the respective reducers are likely to be different due to variation in accuracy of the sun roller and the planetary rollers, wherein the variation in accuracy is caused at a time of production. Moreover, if load fluctuation occurs, there arises another problem in that the reduction ratio is likely to be changed due to slipping caused between the sun roller and the planetary roller. When the reduction ratios of the reducers are different, a feed amount of the recording paper becomes different in the perspective printers. In this case, variation in printing length of a print image is caused. Further, if the reduction ratio is changed due to the load fluctuation, variation of the printing length is caused relative to the print images printed by a single printer.

SUMMARY OF THE INVENTION

In view of the foregoing, it is a primary object of the present invention to provide a printer and a printing method in which variation in printing length is restrained.

In order to achieve the above and other objects, the printer according to the present invention comprises a rotary encoder, a counter, a feed-error detector and a printing length controller. In the printer, driving force of a motor is transmitted to a feed roller via a reducer. While the feed roller moves a recording paper, a line print head records a one-frame image one line by one line. The rotary encoder is rotated in association with the feed roller and generates a pulse whenever the feed roller rotates by a unit angle. The counter counts the pulses generated by the rotary encoder. A measured number of the pulses counted by the counter is equivalent to an actual feed amount of the recording paper. The feed-error detector compares the actual feed amount with a predetermined reference feed amount to detect a difference between them as a feed error whenever printing of the line is performed by a predetermined number. In case that the feed error occurs, the printing length controller changes a printing cycle of the line print head and adjusts a recording width of each line so as to eliminate the feed error while recording of the succeeding line is performed by the predetermined number. By the printing length controller, the printing length of the one-frame image is adjusted to a predetermined target printing length.

In a preferred embodiment, the printing length controller divides the feed error by the predetermined number to obtain a division error, which is regarded as an adjustment amount of the printing cycle corresponding to one line. The division error is added to or subtracted from the printing cycle of each line to adjust the recording widths of the respective lines.

The print head may record a full-color image by superposing images of yellow, magenta and cyan on the recording paper while the recording paper is reciprocated. In this case, it is preferable that the count number of the counter is reset just before printing the yellow image to determine a print-start reference position, from which printing the magenta image and the cyan image is started.

The printing method of the present invention comprises the steps of counting the pulses generated from the rotary encoder, and detecting the feed error by comparing the actual feed amount of the recording paper, which is equivalent to the measured number of the counted pulses, with the predetermined reference feed amount. The feed error is detected as the difference between the actual feed amount and the reference feed amount whenever recording of the line is performed by the predetermined number. The printing method further comprises the step of changing the printing cycle of the line print head to adjust the recording width of each line in case that the feed error occurs. The printing cycle of the line print head is changed so as to eliminate the feed error while recording of the succeeding line is performed by the predetermined number. In virtue of this, the printing length of the one-frame image is adjusted to the predetermined target printing length.

According to the present invention, it is possible to prevent variation of the printing length. Further, in the case that the images of yellow, magenta and cyan are superposed to record a full-color image, the count number of the counter is reset just before printing the yellow image to determine the print-start reference position, from which printing the magenta image and the cyan image is started. Thus, it is possible to prevent color shift (misregistration) of the images of yellow, magenta and cyan.

DESCRIPTION OF THE PREFERRED EMBODIMENTS

Figure 1:
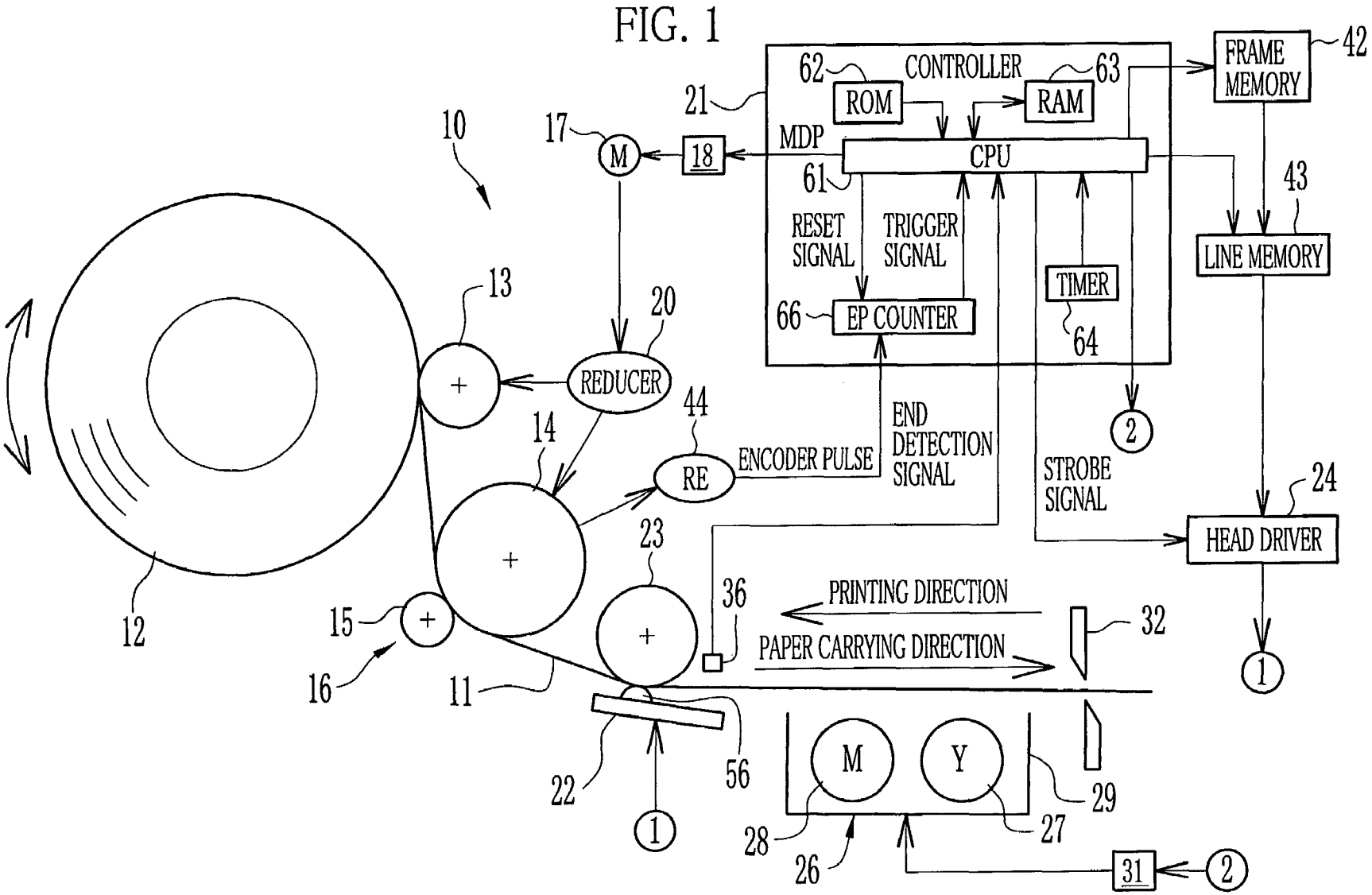
FIG. 1 is a schematic illustration showing a structure of a color direct thermal printer.

A color direct thermal printer 10 shown in FIG. 1 retrieves image data from a memory card, a hard disk drive of a personal computer, and so forth to print an image on a recording paper 11. The color direct thermal printer 10 is loaded with a recording-paper roll 12 in which a strip of the color thermosensitive recording paper 11 is wound in a roll form. The color thermosensitive recording paper (hereinafter, simply referred to as recording paper) 11 comprises cyan, magenta and yellow thermosensitive coloring layers which are formed on a support in order as is well known. The uppermost yellow thermosensitive coloring layer has the highest heat sensitivity and is colored in yellow by small thermal energy. The lowermost cyan thermosensitive coloring layer has the lowest heat sensitivity and is colored in cyan by large thermal energy. The yellow thermosensitive coloring layer loses its coloring ability when yellow fixing rays are applied thereto. The yellow fixing rays are blue-violet visible rays of which peak emission wavelength is about 420 nm. The magenta thermosensitive coloring layer is colored in magenta by thermal energy, which is intermediately ranked between those of the yellow and cyan thermosensitive coloring layers. The magenta thermosensitive coloring layer loses its coloring ability when magenta fixing rays are applied thereto. The magenta fixing rays are near ultraviolet rays of which peak emission wavelength is about 365 nm.

A paper roller 13 abuts on an outer circumference of the recording-paper roll 12. By rotating the paper roller 13, an anterior end of the recording paper 11 is drawn from the roll 12 to a passage. At a downstream side of the paper roller 13, is disposed a feed roller 16 comprising a capstan roller 14 and a pinch roller 15. At a time of paper feeding, the pinch roller 15 is separated from the capstan roller 14 so as to form a gap between the rollers 14 and 15. After the recording paper 11 has been inserted into the gap formed between the rollers 14 and 15, the pinch roller 15 approaches the capstan roller 14 to nip the recording paper 11 therewith. In the state that the feed roller 16 nips the recording paper 11, the feed roller 16 reciprocates the recording paper 11 in a paper carrying direction and a printing direction.

The paper roller 13 and the feed roller 16 are rotated by a motor 17 in forward and backward directions. A rotating speed and a rotational amount of the motor 17 are controlled by a controller 21 via a motor driver 18. As the motor 17, a stepping motor is used for example. The rotational amount of the stepping motor is determined in accordance with a number of pulses supplied thereto. The controller 21 counts the motor drive pulses (MDP) supplied to the motor 17 to control a movement amount of the recording paper 11. The rotation of the motor 17 is transmitted to the paper roller 13 and the feed roller 16 via a reducer 20, which is of a traction-driven type for example.

At a downstream side of the feed roller 16, a thermal head 22 is disposed. As is well known, the thermal head 22 comprises a heating element array 56 in which a large number of heating elements are arranged in a scanning direction. The thermal head 22 is a line printing head for recording an image one line by one line. In a state that the heating element array 56 is pressed against the recording paper 11, the thermal head 22 activates the respective heating elements corresponding to pixels to apply thermal energy to the recording paper 11 in accordance with density of image data. In this embodiment, the heating element array 56 is formed so as to be longer than a width of the recording paper 11 so that an image is adapted to be recorded on the entire width of the recording paper 11.

The image data is retrieved from a PC and an electronic camera to the printer 10. The retrieved image data is written in a frame memory 42. The image data includes gradation values of R, G and B concerning the respective pixels. The controller 21 converts the image data into print data of the respective colors of Y, M and C. In addition, the controller 21 performs various image correcting processes of gamma correction and so forth for the print data. The processed print data is written in the frame memory 42 again. The print data of one frame is transferred to a line memory 43 one line by one line every color. A head driver 24 retrieves the print data of one line from the line memory 43 and drives the thermal head 22 on the basis of the retrieved data.

At a position confronting the thermal head 22, a platen roller 23 is disposed to support the recording paper 11 from a back side thereof. The platen roller 23 is rotated in association with the movement of recording paper 11 to stabilize the contact condition of the recording paper 11 and the heating element array 56. Meanwhile, the thermal head 22 is swingable between a press position and an evacuation position. In the press position, the thermal head 22 presses the heating element array 56 against a recording surface of the recording paper 11. In the evacuation position, the thermal head 22 is evacuated from the press position to separate from the recording paper 11. When the thermal head 22 is moved to the evacuation position, a gap through which the recording paper 11 passes is formed between the thermal head 22 and the platen roller 23. Under the condition that the thermal head 22 is kept in the evacuation position, the recording paper 11 is moved in the paper carrying direction. The thermal head 22 is moved to the press position at the time of printing.

At the beginning of printing, the recording paper 11 is moved in the paper carrying direction to carry a recording area toward a downstream side of the thermal head 22 in the paper carrying direction. After the recording area has passed the thermal head 22, the recording paper 11 is further forwarded by a predetermined distance and is stopped. In this state, the thermal head 22 is pressed against the recording paper 11. And then, the recording paper 11 is moved in a reverse direction relative to the paper carrying direction, namely is moved in a printing direction. During this movement of the recording paper 11, printing is started.

An optical fixing unit 26 is disposed at the downstream side of the thermal head 22 in the paper carrying direction. The optical fixing unit 26 includes a yellow fixing lamp 27, a magenta fixing lamp 28 and a reflector 29. The yellow fixing lamp 27 emits the yellow fixing rays, and the magenta fixing lamp 28 emits the magenta fixing rays. The controller 21 controls lighting and light quantity of the fixing lamps 27 and 28 via a lamp driver 31. Optical fixation for the respective images of yellow and magenta is performed whenever printing of the respective images is completed and while the recording paper 11 is moved in the paper carrying direction. When the recording area passes an above portion of the optical fixing unit 26, the fixing rays corresponding to the respective colors are applied thereto.

A cutter 32 is disposed at a downstream side of the optical fixing unit 26 in the paper carrying direction. The cutter 32 cuts the recording area of the recording paper 11, for which thermal recording and fixation have been completed, into a singe sheet having a predetermined length. The cut sheet is discharged to the outside through a paper discharge port. The unrecorded area of the recording paper 11 is rewound to the recording-paper roll 12.

A sensor 36 for detecting the anterior end of the recording paper 11 is disposed between the thermal head 22 and the optical fixing unit 26. As the anterior-end detecting sensor 36, a photo sensor is used for instance. On the basis of a detection signal of the sensor 36, the controller 21 obtains timing for commencing the count of the MDP supplied to the motor 17.

Meanwhile, the capstan roller 14 is provided with a rotary encoder (RE) 44. The rotary encoder 44 generates encoder pulses, a number of which corresponds to a rotational amount of the capstan roller 14, and outputs the encoder pulses to the controller 21, which counts this encoder pulses to obtain an actual feed amount (measured feed amount) of the recording paper 11.

The motor 17 rotates at a constant speed so as to keep the movement speed of the recording paper 11 constant while printing is performed. The controller 21 counts the motor drive pulses supplied to the motor 17 to obtain timing for commencing the print of the respective lines. However, in spite of rotating the motor 17 at a constant speed, the movement speed of the recording paper 11 varies if a reduction ratio of the reducer 20 is different about the respective printers. In this case, among the different printers, variation is caused in printing lengths of one-frame print images. Meanwhile, the reduction ratio of the reducer 20 is sometimes changed due to load fluctuation. In this case, the print images printed by the same printer have different printing lengths.

In view of this, the controller 21 detects a feed-amount difference (feed error) between the actual feed amount, which is measured on the basis of the encoder pulses, and a reference feed amount. In accordance with the feed error, printing cycles of the respective lines are adjusted to make the printing length of one frame coincide with a target printing length.

The controller 21 comprises a CPU 61, a ROM 62, a RAM 63, a timer 64 and an EP counter 66 to integrally control the respective sections of the printer 10. The ROM 62 is a non-volatile memory for storing a control program and data concerning various parameters and so forth to be used for control. The RAM 63 is a work memory to be used at a time when the CPU 61 executes the program. The CPU 61 loads the control program from the ROM 62 to the RAM 63 to execute processing steps written in the control program.

The timer 64 measures the printing cycles of the respective lines. On the basis of signals outputted from the timer 64, the CPU 61 sends a strobe signal (print timing signal including the printing cycle) of each line to the head driver 24. In synchronization with the strobe signal, the head driver 24 activates the thermal head 22.

The EP counter 66 counts the encoder pulses outputted from the rotary encoder 44. A value of the EP counter 66 is decreased when the recording paper 11 is moved in the paper carrying direction, namely when the feed roller 16 rotates in a counterclockwise direction in the drawing. In contrast, the value of the EP counter 66 is increased when the recording paper 11 is moved in the printing direction, namely when the feed roller 16 rotates in a clockwise direction in the drawing.

Such as described above, the encoder pulses are utilized for detecting the feed error while printing is performed. The controller 21 refers to the value of the EP counter 66 and controls print start positions of the images of the respective colors. A full-color image is completed by superposing the plural colors. If print positions of the respective colors are different, misregistration occurs in spite of making the printing lengths of the images of the respective colors coincide with each other. In this case, it is impossible to obtain a clear full-color image. The misregistration is prevented by making the print start positions of the images of the respective colors coincide with each other.

Figure 2:
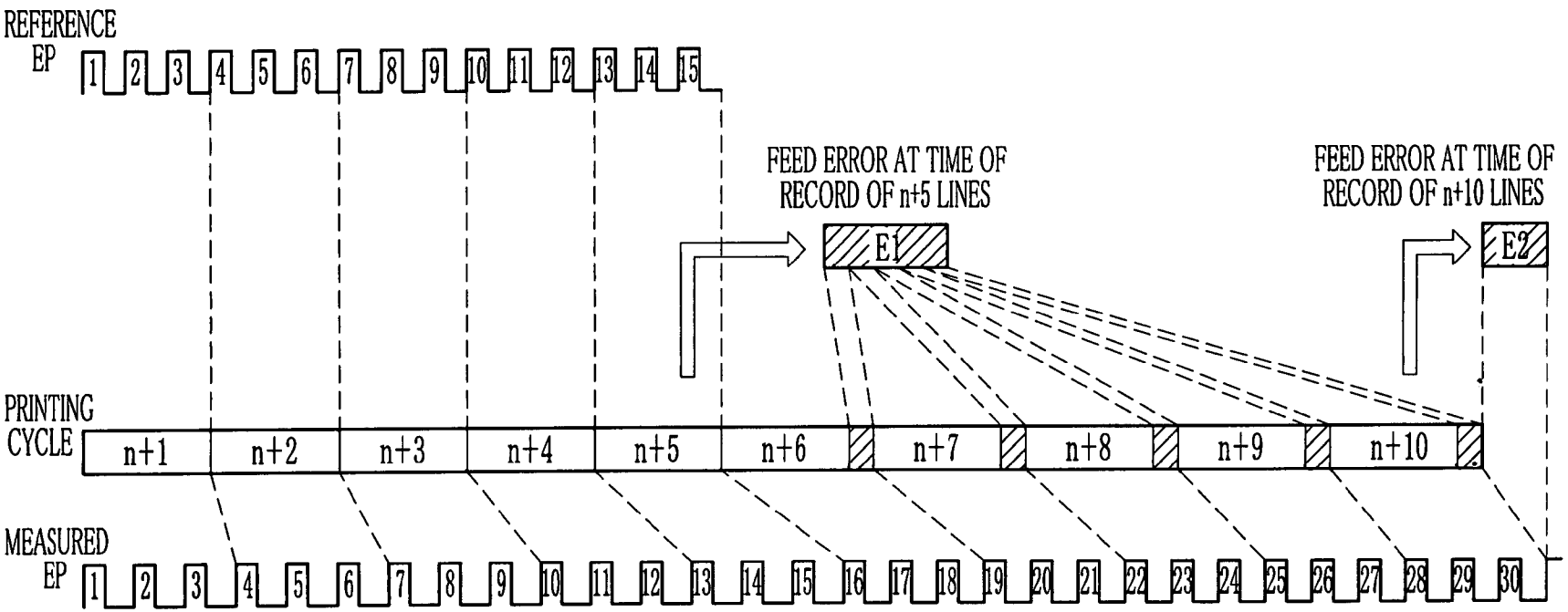
FIG. 2 is an explanatory illustration showing control of a printing cycle performed on the basis of a feed error.

FIG. 2 is an explanatory illustration showing a method for adjusting the printing length on the basis of the encoder pulse. On the basis of the MDP supplied to the motor 17, the CPU 61 determines timing of the strobe signal to be supplied to the head driver 24. The thermal head 22 performs recording one line by one line for the currently moved recording paper 11 in the printing cycle and at the print start timing, which are specified by the strobe signal.

A cycle of reference encoder pulses (reference EP) corresponding to the reference feed amount is stored in the ROM 62 so as to relate to a number of the motor drive pulses. The controller 21 counts the motor drive pulses and reads the number of the reference encoder pulses, which corresponds to the counted number of the motor drive pulses, from the ROM 62. And then, the controller 21 compares the read number of the reference encoder pulses with a number of the measured encoder pulses (measured EP) to detect the feed error.

When the recording paper 11 has no feed error, the cycle of the reference EP coincides with the cycle of the measured EP outputted from the rotary encoder 44. In this case, the printing lengths have no variation, since the respective lines are recorded in a predetermined reference printing cycle and at a predetermined reference print timing. In practice, however, the feed error is caused by the reducer 20. Due to this, difference is caused between the reference printing cycle and the cycle of the measured EP. In particular, since the recording paper 11 is moved at the time of printing in the state that the thermal head 22 is pressed against the recording paper 11, a high load is applied to the reducer 20 and the feed error is likely to be caused.

In case that delay is caused in feeding of the recording paper 11 at the time of printing, a recording width of each line becomes narrow if each line is recorded in the reference printing cycle. Consequently, the printing length becomes short. The CPU 61 compares the numbers of both of the measured EP and the reference EP to detect the feed error E on the basis of the difference between them whenever the lines of a predetermined number (five lines, for instance) are recorded. And then, with respect to the next five lines, the printing cycle of each line is adjusted so as to eliminate the feed error E. For example, the CPU 61 divides the detected feed error E1 into five to find a division error regarded as an adjustment amount of the printing cycle corresponding to one line. The division error is assigned to the printing cycle of each of the next five lines. When the feed amount lacks relative to the reference feed amount, the division error is added to the printing cycle of each line. In contrast, when the feed amount exceeds the reference feed amount, the division error is subtracted from the printing cycle of each line.

The printing cycle adjusted in this way is inputted into the head driver 24 as the strobe signal by means of the CPU 61. In accordance with this strobe signal, the next five lines are recorded. In virtue of this, the recording width of each line is adjusted so that the feed error E1 is eliminated and the printing length approaches the target printing length. After recording the next five lines, the feed error E2 is detected again, and then the printing cycle of each of the subsequent five lines are adjusted so as to eliminate the feed error E2. Such control for the printing cycle is repeated until completion of one-frame recording to adjust the printing length of one frame. By the way, in this embodiment, the feed error is detected every five lines. However, this is the mere example. The detection interval of the feed error may be more or less than the five lines. In the meantime, when the recording paper 11 is moved in the paper carrying direction, the thermal head 22 is kept in the evacuation position. Thus, at this time, the load applied to the reducer 20 is small and the feed error is hardly caused. For this reason, it is sufficient to consider the feed error only when the recording paper is moved in the printing direction.

Figure 3A:
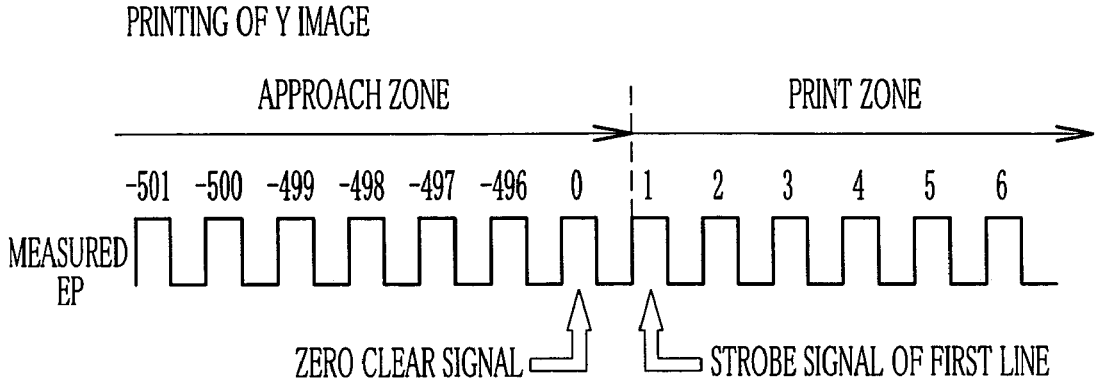
FIGS. 3A, 3B and 3C are explanatory illustrations showing control of a print start position.
Figure 3B:
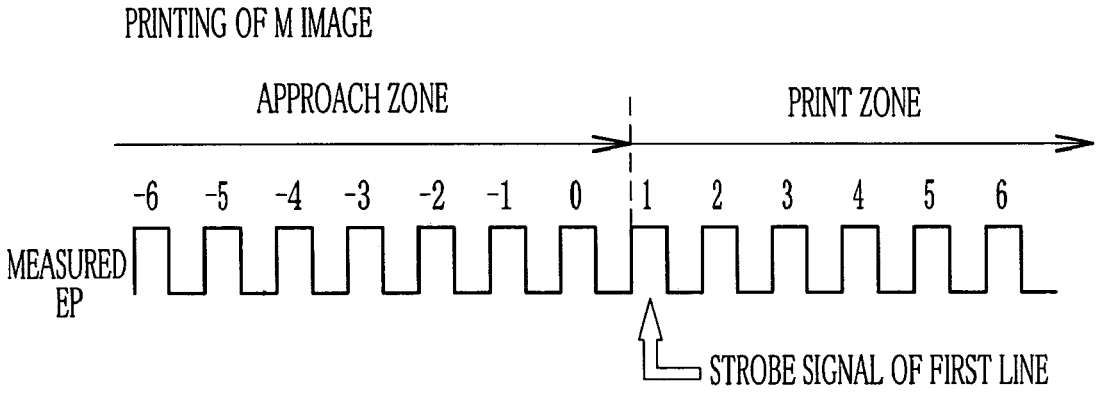
Figure 3C:
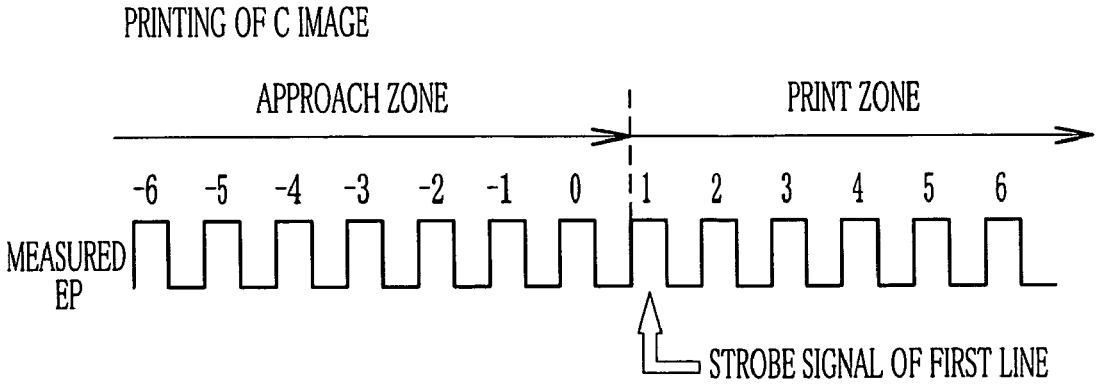

The EP counter 66 is also used for controlling the print start position of each color image of Y, M and C such as shown in FIGS. 3A to 3C. The recording paper 11 is moved in the paper carrying direction before printing. As described above, the optical fixation is performed after printing of each color of Y and M. For the purpose of the optical fixation, the recording paper 11 is moved in the paper carrying direction until the entire recording area passes the optical fixing unit 26. The CPU 61 counts the MDP to move the recording paper 11 by a predetermined amount. At this time, the EP counter 66 deceases the counter value. Upon moving the recording paper 11 to the predetermined position, the thermal head 22 is pressed against the recording paper 11 and it is commenced to move the recording paper 11 in the printing direction. During this movement of the recording paper 11, the EP counter 66 increases the counter value.

The CPU 61 counts the MDP at the print time of the Y image to judge that the recording paper 11 is closely moved to the print start position. Upon this judgment, the CPU 61 sends a reset signal to the EP counter 66 to clear the counter value to zero and to restart the EP counter 66. A reset point defined in this way is regarded as a print-start reference point. When the counter value of the EP counter 66 has reached "1", the EP counter 66 outputs a trigger signal to the CPU 61. In response to this trigger signal, the CPU 61 outputs the strobe signal of the first line of the Y image to start the print of the Y image. After printing the Y image, the recording paper 11 is returned from the print zone to the approach zone. At this time, the EP counter 66 decreases the counter value from the positive value to the negative value. Moreover, during this return, the yellow fixing lamp 27 is turned on to optically fix the Y image.

After optically fixing the Y image, the recording paper 11 is moved in the printing direction again. At this time, the counter value is increased. When the counter value has reached "1" as shown in FIG. 3B, the EP counter 66 outputs the trigger signal to the CPU 61. In response to this trigger signal, the CPU 61 outputs the strobe signal of the first line of the M image to start the print of the M image. Also at the print time of the C image, as shown in FIG. 3C, the CPU 61 similarly outputs the strobe signal of the first line of the C image in response to the trigger signal, which is outputted from the EP counter 66, to start the print of the C image. In this way, the print start positions of the respective colors are adjusted on the basis of the counter value of the EP counter 66.

Figure 4:
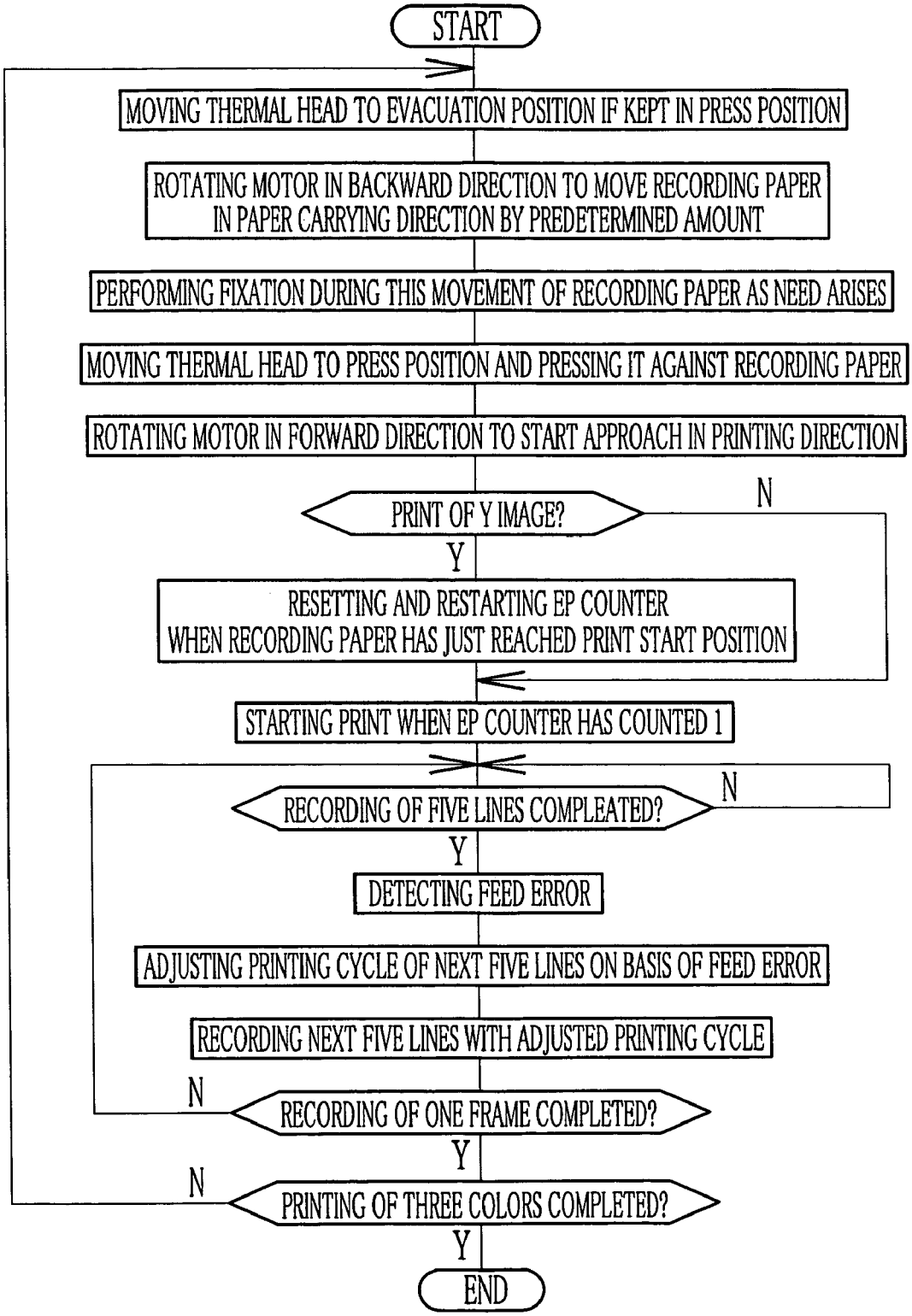
FIG. 4 is a flowchart showing a printing sequence.

An operation of the above structure is described below along a flowchart shown in FIG. 4. At the time of paper feeding, the thermal head 22 is kept in the evacuation position. In this condition, the motor 17 is rotated and it is started to move the recording paper 11 in the paper carrying direction. The CPU 61 counts the MDP to move the recording paper 11 in the paper carrying direction by the predetermined amount. After stopping this movement of the recording paper 11, the thermal head 22 is moved to the press position to press the recording paper 11. Successively, the motor 17 is reversed to start the approach in the printing direction.

The CPU 61 counts the MDP to reset and restart the EP counter 66 at the time when the anterior end of the recording area has just arrived at the print start position of the thermal head 22. When the counter value of the EP counter 66 has reached "1", the print of the Y image is started. Whenever five lines are recorded, the feed error E is detected. On the basis of the feed error E, the printing cycle of the next five lines is adjusted. The next five lines are recorded at the adjusted printing cycle. In this way, the Y image of one frame is recorded, adjusting the printing cycle on the basis of the feed error.

After printing the Y image, the thermal head 22 is moved to the evacuation position and the recording paper 11 is moved in the paper carrying direction. At this time, the Y image is optically fixed. After the optical fixation, the thermal head 22 is pressed against the recording paper 11 and the movement direction of the recording paper is reversed to start the approach. When the counter value of the EP counter 66 has reached "1", the print of the M image is started. While the M image is printed, the printing cycle is adjusted on the basis of the feed error E similarly to the Y image. After printing the M image, optical fixation is performed. Successively, the C image is printed similarly to the Y and M images. In this way, the three colors are printed so that the full-color image is obtained.

As described above, the printing cycle of each line is adjusted on the basis of the feed error so as to make the printing length of each color image coincide with the target printing length. Thus, the printing length is prevented from fluctuating due to load change of the reducer so that the printing lengths of the print images become uniform. Moreover, it is also prevented that the printing length fluctuates due to difference of the reducers of the respective printers. Consequently, the variation of the printing lengths is resolved with respect to the different printers. Further, by adjusting the print start position in addition to the control of the printing length, misregistration is also prevented.

Figure 5:
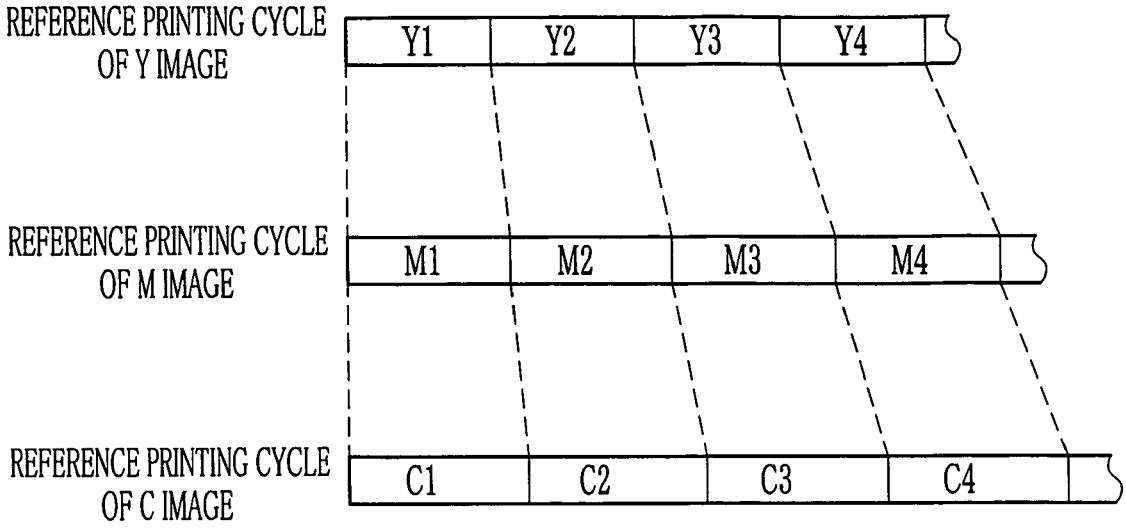
FIG. 5 is an explanatory illustration showing reference printing cycles of Y, M and C images.

In the above embodiment, as to the three colors of Y, M and C, the reference printing cycles thereof are identical. However, the printing thermal energy of the respective colors of Y, M and C are different from each other. Thus, an effective radius of the recording paper wound around the feed roller changes in accordance with heating of the thermal head. Moreover, μ-value concerning the head and the recording paper fluctuates. Due to the change of the effective radius and the fluctuation of the μ-value, the printing length fluctuates. In view of this, such as shown in FIG. 5, the reference printing cycle may be altered for the respective colors of Y, M and C. Since the printing thermal energy becomes larger in an order of Y, M and C, a stretch amount of the recording paper is smallest with respect to Y and is greatest with respect to C. In consideration of this, the reference printing cycle of Y is set so as to be shortest, and the reference printing cycle of C is set so as to be longest. The reference printing cycles of the respective colors are stored in the ROM 62 and are read out by the CPU 61. On the basis of the reference printing cycles of the respective colors, the printing cycle affected by the feed error is adjusted for each line.

Figure 6:
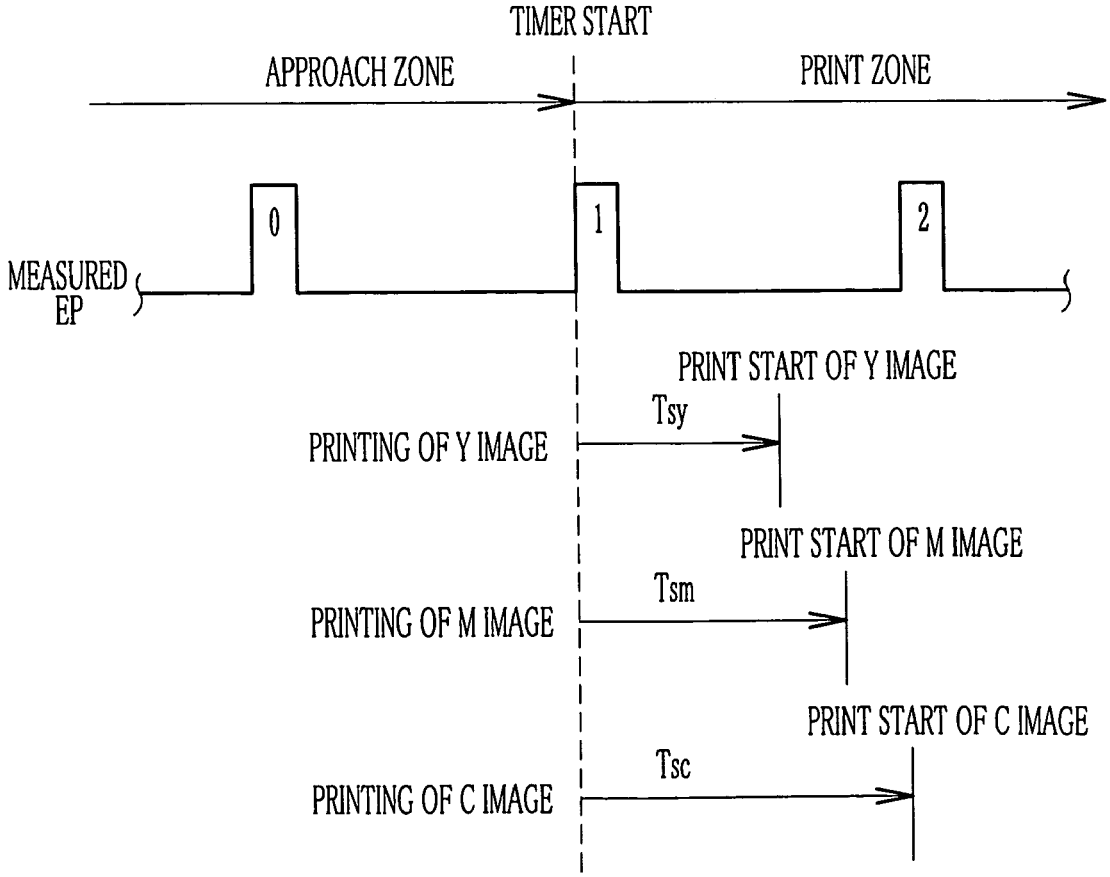
FIG. 6 is a chart showing print start timing of Y, M and C images.

As shown in FIG. 6, the print start timing of the first line may be similarly changed with respect to each color, taking into account the differences of the stretch amounts of the recording paper which are caused by the print thermal energy of Y, M and C. Concretely, the print start timing of the Y image, the print energy of which is smallest, is adapted to be earliest. Moreover, the print start timing of the C image, the print energy of which is largest, is adapted to be latest. In virtue of this, the print start positions of the respective colors conform to each other on the recording paper so that positional difference to be caused due to the print thermal energy is prevented. For controlling the print start timing, the timer 64 is used. For example, time interval Ts is preset with respect to each color. The time interval Ts means an interval to be taken until print start from the time when the counter value of the EP counter 66 has reached "1". The time intervals Tsy, Tsm and Tsc of the respective colors are stored beforehand in the ROM 62, for instance. When the counter value has reached "1", the timer 64 is started. And then, the print of each color is started when the corresponding time interval among Tsy, Tsm and Tsc has passed.

The above embodiments relate to the printer for recording the full-color image. The present invention, however, may be adopted to a printer for recording a monochrome image. Moreover, in the above embodiments, the control of the print start position is executed in addition to the control of the printing length. However, either control may be merely executed. In particular, when the monochrome image is printed, the problem concerning misregistration is not caused so that it is unnecessary to control the print start position.

In the above embodiments, the present invention is adopted to the color direct thermal printer using the thermosensitive recording paper, which is heated and colored by the thermal head. The present invention, however, may be adopted to a thermal transfer printer in which an ink sheet is heated by a thermal head and an ink thereof is transferred to a recording paper. Besides the thermal printer, the present invention may be adopted to various line printers of an ink-jet printer, a laser printer and so forth.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A printer in which a print head records a one-frame image one line by one line while a recording paper is moved by a feed roller to which driving force of a motor is transmitted via a reducer, said printer comprising:

a rotary encoder for generating a pulse whenever said feed roller rotates by a unit angle;

a counter for counting said pulse, a pulse number counted by said counter being equivalent to an actual feed amount of said recording paper;

a feed-error detector for comparing said actual feed amount with a predetermined reference feed amount to detect a difference between these amounts as a feed error whenever recording of the line is performed by a predetermined number; and a printing-length controller for adjusting a printing length of said one-frame image to a predetermined target printing length, said printing-length controller changing a printing cycle of said print head to control a recording width of each line such that the detected feed error is eliminated while recording of the succeeding line is performed by the predetermined number.

2. The printer according to claim 1, wherein said printing-length controller divides said feed error by said predetermined number to obtain a division error, which is regarded as an adjustment amount of the printing cycle corresponding to one line, and said division error is added to or subtracted from the printing cycle of each line to control said recording width.

3. The printer according to claim 1, wherein said print head records a full-color image by superposing three-color images of yellow, cyan and magenta on said recording paper while said recording paper is reciprocated.

4. The printer according to claim 3, wherein a count value of said counter is reset just before printing the yellow image to set a print-start reference point, and printing the magenta image and the cyan image is started on the basis of said print-start reference point.

5. The printer according to claim 4, wherein printing of each of the yellow, magenta and cyan images is started at prescribed timing based on said print-start reference point.

6. The printer according to claim 5, wherein said prescribed timing is identical on the yellow, magenta and cyan images.

7. The printer according to claim 6, wherein said prescribed timing is the moment when said counter has counted "1".

8. The printer according to claim 5, wherein said prescribed timing is different on the yellow, magenta and cyan images, the timing of the yellow image being earliest and the timing of the cyan image being latest.

9. A printing method in which a print head records a one-frame image one line by one line while a recording paper is moved by a feed roller to which driving force of a motor is transmitted via a reducer, said printing method comprising the steps of:

generating a pulse from a rotary encoder whenever said feed roller rotates by a unit angle;

counting said pulses, a counted pulse number being equivalent to an actual feed amount of said recording paper;

comparing said actual feed amount with a predetermined reference feed amount to detect a difference between these amounts as a feed error whenever recording of the line is performed by a predetermined number; and changing a printing cycle of said print head to control a recording width of each line such that the detected feed error is eliminated while recording of the succeeding line is performed by the predetermined number, a printing length of said one-frame image being adjusted to a predetermined target printing length by controlling said recording width of each line.

10. The printing method according to claim 9, wherein said feed error is divided by said predetermined number to obtain a division error, which is regarded as an adjustment amount of the printing cycle corresponding to one line, and said division error is added to or subtracted from the printing cycle of each line to control said recording width.

11. The printing method according to claim 9, wherein a full-color image is recorded by superposing three-color images of yellow, cyan and magenta on said recording paper while said recording paper is reciprocated.

12. The printing method according to claim 11, wherein said counted pulse number is reset just before printing the yellow image to set a print-start reference point, and printing the magenta image and the cyan image is started on the basis of said print-start reference point.

13. The printing method according to claim 12, wherein printing of each of the yellow, magenta and cyan images is started at prescribed timing based on said print-start reference point.

14. The printing method according to claim 13, wherein said prescribed timing is identical on the yellow, magenta and cyan images.

15. The printing method according to claim 14, wherein said prescribed timing is the moment when said counted pulse number has become "1".

16. The printing method according to claim 13, wherein said prescribed timing is different on the yellow, magenta and cyan images, the timing of the yellow image being earliest and the timing of the cyan image being latest.

* * * * *